US005555598A

United States Patent [19]

Grave et al.

[11] Patent Number: 5,555,598

[45] Date of Patent: Sep. 17, 1996

[54] CLEANING TOOL HEAD WITH OVERLAPPING AND OFFSET FLUID SPRAY PATTERNS

[75] Inventors: Dale L. Grave, Plymouth; Sung K. Cho, Roseville, both of Minn.

[73] Assignee: CFR Corporation, New Brighton, Minn.

[21] Appl. No.: 416,290

[22] Filed: Apr. 4, 1995

[51] Int. Cl.[6] ..... A47L 11/34

[52] U.S. Cl. ..... 15/322

[58] Field of Search ..... 15/322, 320, 321, 15/415.1, 420

[56] References Cited

U.S. PATENT DOCUMENTS

| | | | |
|---|---|---|---|
| 3,262,146 | 7/1966 | Hays | 68/222 |
| 3,739,417 | 6/1973 | Sawyer | 15/320 |
| 3,840,935 | 10/1974 | Gitzgerald, Jr. et al. | 15/320 |
| 4,168,562 | 9/1979 | Maasberg | 15/322 |
| 4,392,270 | 7/1983 | Magee | 15/322 |
| 4,488,330 | 12/1984 | Grave | 15/322 |
| 4,596,061 | 6/1986 | Henning | 15/322 |
| 4,649,594 | 3/1987 | Grave | 15/322 |
| 4,654,925 | 4/1987 | Grave | 15/322 |
| 4,720,889 | 1/1988 | Grave | 15/322 |
| 4,833,752 | 5/1989 | Merrick | 15/322 |
| 4,879,784 | 11/1989 | Shero | 15/322 |
| 5,125,126 | 6/1992 | Bonnant | 15/322 |

FOREIGN PATENT DOCUMENTS

| | | | |
|---|---|---|---|
| 892658 | 3/1968 | United Kingdom | 15/322 |

*Primary Examiner*—David Scherbel
*Assistant Examiner*—Tony G. Soohoo
*Attorney, Agent, or Firm*—Frederick W. Niebuhr, Esq.

[57] ABSTRACT

A continuous flow recycling surface cleaning device includes a cleaning tool head incorporating a nozzle arrangement to enhance surface cleaning and drying. The head includes a shell that engages a surface being cleaned to form an enclosed chamber. A partition divides the chamber into intake and evacuation compartments. A row of nozzles is mounted to the shell to spray liquid cleaning solution into the intake compartment. Air enters the receiving sector through slots near the nozzles and between a forward portion of the shell and the floor, and is drawn beyond the partition into the evacuation compartment by a vacuum source. Each of the nozzles generates a sheet-like, fan-shaped spray pattern. The nozzles are arranged to form adjacent spray patterns that overlap one another longitudinally (lengthwise of the elongate shell) but are separated from one another to avoid interference between adjacent spray patterns. In one particularly advantageous arrangement, the nozzles are angularly offset from the lengthwise direction to form parallel spray patterns that define air passages between them. The shell, particularly along and adjacent the surface being cleaned, is configured to promote air flow into the intake compartment while resisting air passage into the evacuation compartment.

24 Claims, 5 Drawing Sheets

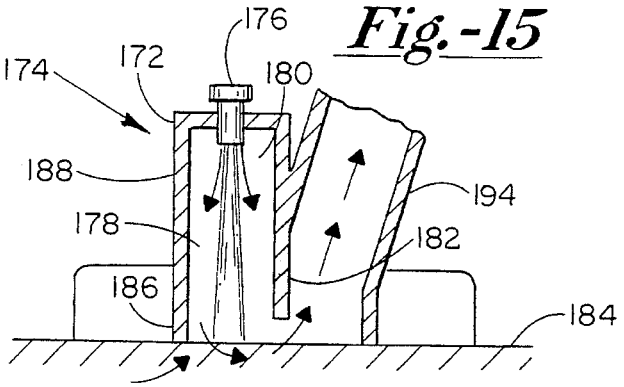
Fig.-15
Fig.-16
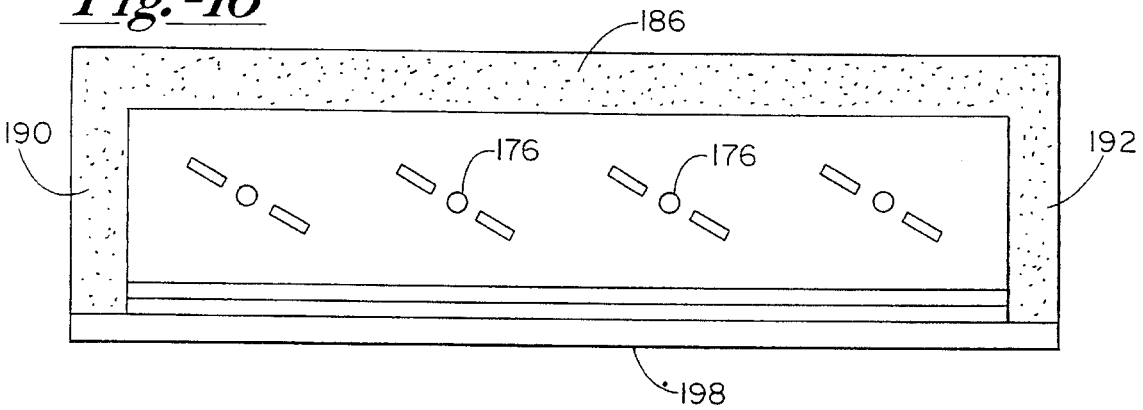

CLEANING TOOL HEAD WITH OVERLAPPING AND OFFSET FLUID SPRAY PATTERNS

The present invention relates to an apparatus for cleaning carpeted floors and other substantially planar surfaces, and more particularly to the cleaning tool heads used in such apparatus.

Cleaning systems that circulate and spray liquids are widely used for cleaning carpets, upholstery, fabric, wall coverings and hard surfaces such as ceramics. According to one such technique known as continuous flow recycling, a liquid cleaning solution is sprayed toward the surface being cleaned. At the same time, a vacuum source creates a high velocity airstream that draws the atomized liquid toward the surface, and into the material beyond the surface in the case of a carpet. Almost immediately the airstream is diverted to draw the liquid upwardly away from the surface (or out of the carpet), and at the same time extract soil, debris and other foreign matter to clean the surface. The rapid and abrupt change in direction promotes efficient recovery of most of the cleaning solution, prevents undesirable soaking of the carpet backing, and substantially reduces drying time.

Cleaning systems that circulate and spray liquids often include a tank of liquid cleaning solution supported on a wheel mounted base or framework. The framework also supports a motor and liquid pump for circulating the cleaning solution. Recycling systems also include a vacuum motor and blower for recovering the solution and returning solution to the tank. In many such systems the cleaning head is not integral with the framework, but rather is coupled to the solution tank through pliable hosing and thus is movable independently. Frequently the connection includes a wand and a length of rigid tubing to enable the operator to orient the cleaning tool head by handling the wand. Patents describing the cleaning heads used in these systems include U.S. Pat. No. 4,649,594 (Grave) and U.S. Pat. No. 4,720,889 (Grave).

The use of independent cleaning tool heads affords several advantages, the most prominent being the ease in manipulating the tool without having to move the tank. Thus, the tool head more easily cleans non-horizontal surfaces, e.g. walls or upholstered furniture.

Alternatively, a surface cleaning apparatus can be self-contained, in the sense of providing a wheel supported housing that incorporates the necessary motors and contains the cleaning fluid, and further supports a cleaning tool head with respect to the same housing, for example through a pair of pivot arms. This type of cleaning apparatus is discussed in U.S. patent application Ser. No. 08/148,588 filed Nov. 4, 1993, and assigned to the assignee of this application.

Both types of devices employ an elongate cleaning tool head. Several fluid spray nozzles are mounted to the head in a single row lengthwise of the head. Liquid cleaning solution is supplied to the nozzles under pressure, through a manifold. Each nozzle sprays a solution in a thin, sheet-like fan-shaped spray pattern that diverges in the direction from the nozzle toward the surface being cleaned. The nozzles are aligned and oriented so that their respective spray patterns lie substantially within a common plane that is parallel to the length of the cleaning tool head. Accordingly, the respective impingement areas of the surface directly sprayed by the nozzles are aligned with the length direction, in a single lengthwise row.

To insure complete, uninterrupted coverage of the surface across the entire cleaning head length, adjacent nozzles are positioned sufficiently close to one another so that their adjacent flow patterns overlap. The amount of overlap is selected to insure complete coverage in view of nozzle positioning tolerances, and also to compensate for the tendency of droplet densities to diminish near the edges of the spray pattern. Consequently a substantial overlap of adjacent spray patterns is required, particularly near the surface being cleaned.

Because of this overlap, adjacent sprays interfere with one another. In the regions of interference, multiple collisions of the droplets dissipate the energy of the moving cleaning fluid. The collisions cause random droplet motion that, in general, reduces droplet velocities. This causes many of the droplets to collect on the surface, forming larger droplets and collecting in pools. Cleaning efficiency is reduced, for several reasons. First, the larger droplets and pools lessen the proportion of cleaning solution retrieved. Because less of the fluid is retrieved, drying times are increased. Attempts to increase the proportion of recovered fluids require substantial increases in vacuum system energy, for accelerating and carrying the collected liquid.

Therefore, it is an object of the present invention to provide a cleaning tool head in which interference among adjacent spray patterns is substantially reduced.

Another object is to provide a cleaning tool head in which liquid spray nozzles are arranged to provide longitudinally overlapping impingement areas on the surface being cleaned, while at the same time providing clear air passageways between adjacent spray patterns.

A further object is to provide, in a cleaning tool head, a shell configured to improve control of the air flowing into the chamber formed by the shell when positioned against the surface being cleaned.

Yet another object is to provide a cleaning system in which a liquid cleaning solution is more effectively applied to the surface being cleaned, and recovered in greater proportion.

SUMMARY OF THE INVENTION

To achieve these and other objects, there is provided a surface cleaning device. The device includes a cleaning tool head that includes a shell and a plurality of fluid spray means mounted to the shell in an array that extends across the shell in a longitudinal direction. The shell has a substantially planar edge means for engaging a surface to determine an operating position of the cleaning tool head. In the operating position the shell and the surface cooperate to define an enclosed chamber. Each of the fluid spray means sprays fluid in a generally planar and sheet-like spray pattern that extends at least approximately in the longitudinal direction. Adjacent spray patterns longitudinally overlap one another at least near the surface. Further, the adjacent spray patterns are offset from one another to provide gaps between the adjacent spray patterns along their respective regions of longitudinal overlap. This prevents any substantial confluence of the adjacent spray patterns before their impingement upon the surface.

This spray pattern offset effectively improves any system in which the cleaning tool head incorporates at least two overlapping nozzles or other fluid spray means. Preferably the fluid spray means are provided as a single row of nozzles, including two end nozzles and at least two interior nozzles. The interior nozzles are offset angularly. Consequently they define elongate spaced apart interior fluid impingement areas on the surface. These impingement areas are substantially parallel to one another and angularly offset from the longitudinal direction. The offset angle of the impingement areas preferably is in the range of 1–15 degrees, and more preferably is about 3 degrees. The end nozzles likewise can be offset, so that their resulting fluid impingement areas are parallel to the interior impingement areas. As an alternative favorable for certain applications, the end nozzles are oriented to define longitudinal end impingement areas.

As further alternatives, the nozzles can be either angled or positionally staggered to form longitudinal impingement areas along the surface, with adjacent impingement areas longitudinally overlapping one another but transversely spaced apart. The result is either a stepped or staggered pattern of impingement areas.

An inlet passage means, in the form of elongate slots through the shell on opposite sides of each nozzle, permits air to enter the chamber as the liquid cleaning solution is being sprayed. Air is drawn in by a combination of a partial vacuum in the chamber and the spraying action, and mingles with the cleaning solution to promote atomizing of the solution for more effective cleaning. Of the above-discussed nozzle arrangements, the arrangement in which all flow patterns are angularly offset from the longitudinal direction is highly preferred, as it most effectively provides clear air passageways between adjacent spray patterns. At the same time, all of these arrangements provide the desired longitudinal overlap without causing adjacent sprays to interfere with one another. With collisions among droplets and the resultant energy dissipation virtually eliminated, the system retains cleaning effectiveness with reduced energy input. Droplets are kept moving over the desired flow path along and through (in the case of carpet) the surface being cleaned. Because the droplets are kept moving, they are more easily recovered, and their tendency to collect into large droplets or pools is virtually eliminated. As a result, the cleaned surface requires less time to dry.

Further air flows enter the chamber along the region where the shell and the cleaned surface are contiguous. When entering a fluid intake compartment of the chamber, these flows enhance retrieval of cleaning solution and soil from the surface. By contrast, much of the air that flows directly into an evacuation compartment of the chamber does not enhance recovery.

Therefore, according to another aspect of the invention a vacuum cleaning apparatus is provided with a cleaning tool head including an elongate shell and a fluid spray means (e.g. one or more nozzles) mounted to the shell. The shell has a substantially planar edge means for engaging a surface to determine an operating position of the cleaning tool head in which the shell and surface cooperate to define a substantially enclosed chamber. A partition inside the chamber extends in a longitudinal direction lengthwise across the chamber. The partition divides the chamber into an intake compartment for receiving fluids and an evacuation compartment for evacuating fluids. The edge means locates the partition to define a narrow longitudinal gap between the partition and the surface, and between the two compartments. The fluid spray means is open to the intake compartment and sprays fluid toward the surface near the gap. A vacuum source is in fluid communication with the evacuation compartment. The vacuum source draws a vacuum, to thereby draw fluids from the intake compartment across the gap and into the evacuation compartment, and eventually out of the chamber. Near the edge means, the shell is configured to facilitate the passage of fluids into the chamber at a first wall portion along the intake compartment. The shell is configured to interfere with the passage of fluids into the chamber at a second wall portion along the evacuation compartment.

The shell configuration depends in part upon the type of surface being cleaned. For flexible and porous surfaces, e.g. carpeting, the shell's first wall portion is substantially rigid and non-porous and provides the edge means. The second wall portion, also non-porous and substantially rigid, extends beyond the edge means and into the carpeting or other material that defines the surface.

For cleaning rigid, non-porous surfaces, the first wall portion is porous proximate the edge means, while the second wall portion is substantially non-porous and flexible, to provide a wiping action against the surface.

Preferably the intake compartment is located forwardly of the evacuation compartment, and the shell is substantially rectangular near the edge means. Then, the first wall portion comprises a forward wall and two opposite side walls of the shell. The second wall portion comprises a rearward wall of the shell.

The above arrangement insures that during cleaning, virtually all air drawn into the chamber at or near the edge means enters the fluid supply compartment rather than the evacuation compartment. Consequently, the air is drawn across the gap between the partition and the surface and aids in recovery of cleaning solution and foreign matter removed or extracted from the surface.

Thus in accordance with the present invention, a cleaning system is made more effective by substantially preventing interference between adjacent cleaning solution sprays, and by more effectively directing the passage of air and solution through the chamber between the cleaning tool head and surface being cleaned.

IN THE DRAWINGS

For a further understanding of the above and other features and advantages, reference is made to the following detailed description and to the drawings, in which:

FIGS. 15 and 16 illustrate an alternative embodiment cleaning tool head.

DETAILED DESCRIPTION OF THE PREFERRED EMBODIMENTS

Figure 1:
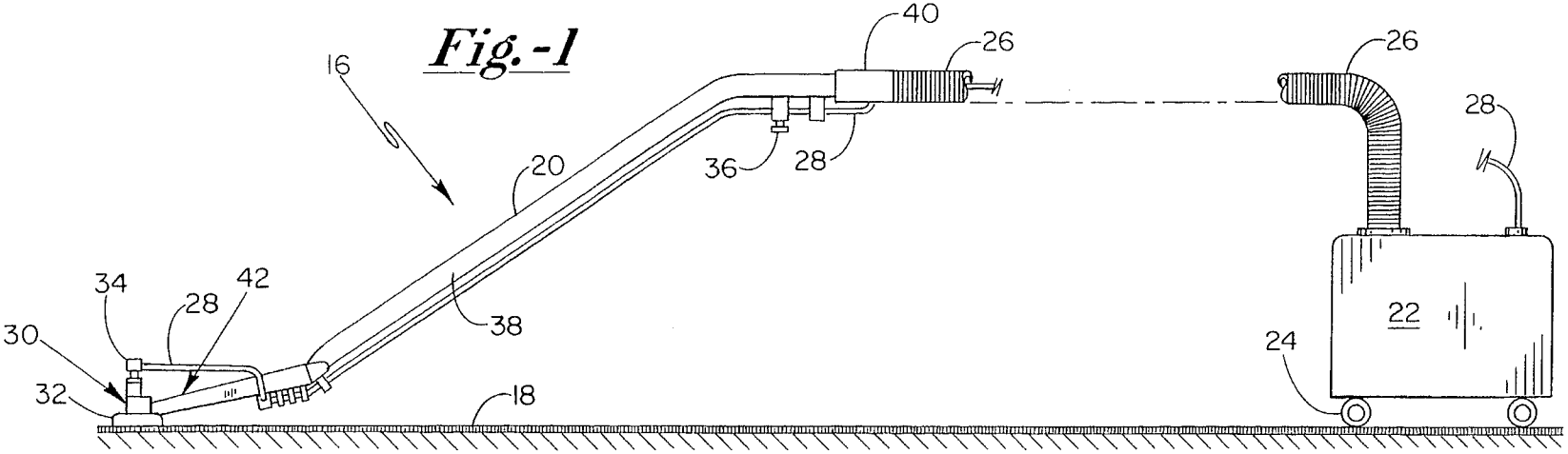
FIG. 1 is a side elevation of a continuous flow recycling surface cleaning device constructed in accordance with the present invention.
Figure 2:
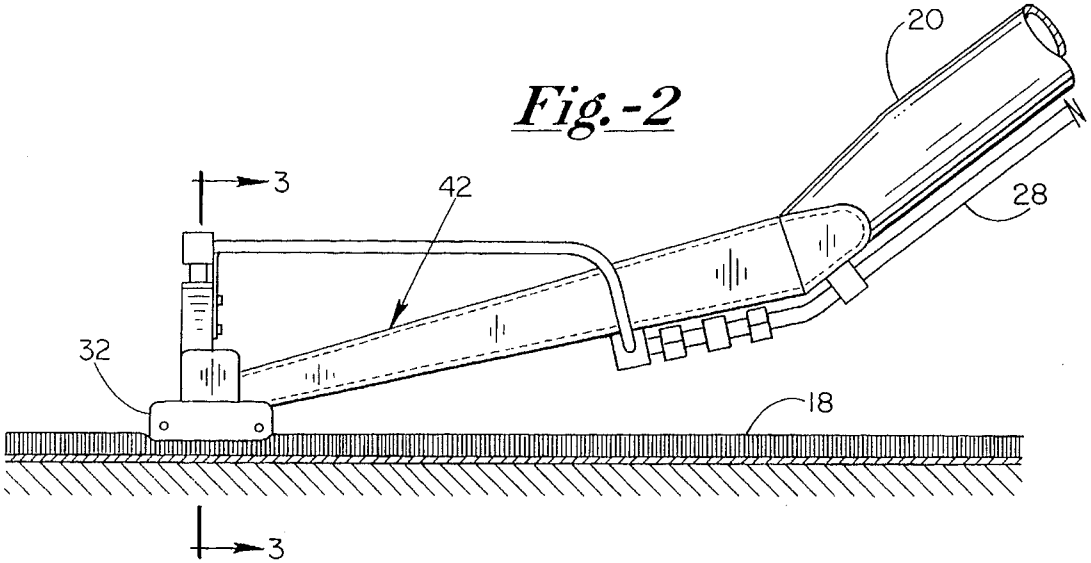
FIG. 2 is an enlarged partial side elevation of the apparatus.

Turning now to the drawings, there is shown in FIGS. 1 and 2 a vacuum operated continuous flow recycling device 16 for cleaning planar surfaces, such as a carpeted floor indicated at 18. The device includes a cleaning tool 20 and a canister or tank 22, supported by wheels 24 that facilitate movement of the canister. The cleaning tool is coupled to the canister by a vacuum conduit or hose 26 and by a fluid supply tubing conduit or tubing 28. Conduits 26 and 28 are sufficiently pliable to allow manipulation of the tool, independently of canister 22. This feature is particularly useful for cleaning non-horizontal surfaces such as walls, ceilings and upholstered furniture.

The cleaning tool includes a cleaning tool head 30, shown in the operating position in which a shell 32 of the head is contiguous with floor 18. In this position, the shell and the floor cooperate to form an enclosed chamber. Liquid cleaning solution is supplied to the chamber via conduit 28 to a manifold 34, and then to a row of nozzles which spray the liquid into the chamber. The cleaning solution is supplied to the manifold under pressure, typically ranging from 50 to 1000 psi and exceeding 1000 psi in some applications. A valve 36 along conduit 28 is adjustable to control the rate at which the cleaning fluid is supplied. At the same time, a motor (not shown) in canister 22 is operated to draw a vacuum through conduit 26, which is in fluid communication with the chamber through a length of rigid tubing 38 that includes a handle 40, and a somewhat triangular vacuum housing 42 open to tubing 38 and to the chamber.

Figure 3:
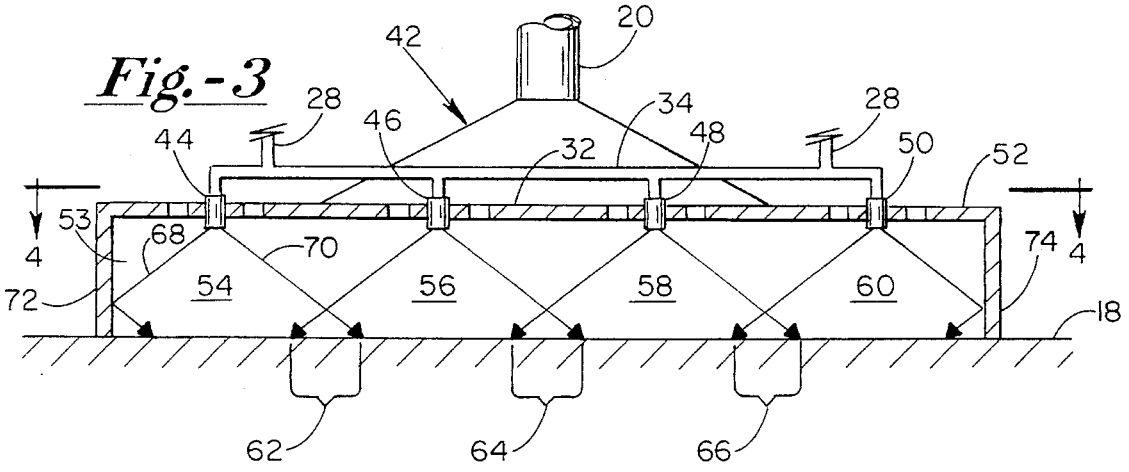
FIG. 3 is a sectional view taken along the line 3—3 in FIG. 2.

As seen in FIG. 3, four fluid spray nozzles, indicated respectively at 44, 46, 48, and 50 are mounted to shell 32 along a top wall 52 of the shell. Nozzles 44–50 are substantially identical to one another and receive the cleaning solution from manifold 34 at the selected pressure. Accordingly, the nozzles spray the cleaning solution into the chamber (indicated at 53) at substantially the same rate and form substantially identical spray patterns, indicated respectively at 54, 56, 58, and 60. Each of the spray patterns is thin and substantially planar, having a fan-like shape. More particularly, the spray patterns have wide profiles that diverge in the direction from each nozzle toward floor 18 as shown in FIG. 3. By contrast, spray pattern profiles taken in vertical planes perpendicular to the plane of FIG. 3 are-quite narrow (e.g. see FIG. 5).

To insure full coverage across the length of shell 32, adjacent spray patterns longitudinally overlap one another. The four nozzles produce three regions of longitudinal overlap, indicated at 62, 64, and 66, respectively. Due to the spray pattern divergence, the region of longitudinal overlap occurs near floor 18, but not generally over the height of the chamber. The density of liquid solution within each spray pattern tends to diminish near the opposite edges of the pattern, indicated at 68 and 70 for spray pattern 54. Accordingly, the regions 62–66 of longitudinal overlap are provided to counterbalance the diminishing density, and to insure complete and continuous fluid coverage. The end nozzles 44 and 50 are positioned so that the outer edges of spray patterns 54 and 60 encounter respective end walls 72 and 74 of the shell before reaching floor 18, to counteract the diminishing density and thus provide more uniform application of the cleaning solution.

Figure 4:
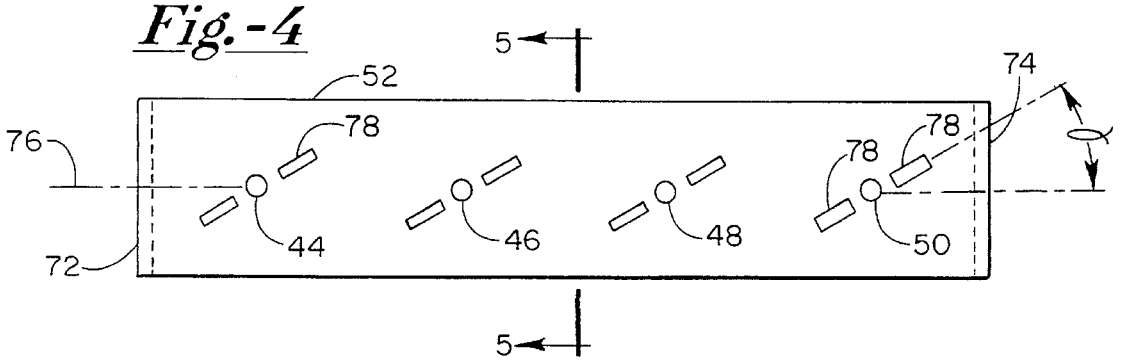
FIG. 4 is a sectional view taken along the line 4—4 in FIG. 3.

FIG. 4 shows top wall 52 of shell 32 beneath manifold 34, to reveal that nozzles 44–50 are mounted in a row that is longitudinal, i.e. parallel to the shell length as indicated by a longitudinal axis 76. The nozzles themselves are not longitudinally aligned, but angularly offset by an offset angle $\alpha$ of about 3 degrees, or more generally in the range of 1–15 degrees. Spray patterns 54–60 likewise are angularly offset by the same angle $\alpha$. Thus, it is to be appreciated that the spray patterns are illustrated with their widest profiles in FIG. 3 as a matter of convenience in illustration, with FIG. 4 emphasizing the angular offset.

Several elongate slots 78 are formed through top wall 52. Two such slots are provided in connection with each of the nozzles, on opposite sides of the nozzle. The motion of cleaning solution through nozzles 44–50 creates a positive pull that draws air through slots 78, in cooperation with the vacuum created in the chamber. Thus, air enters the chamber through slots 78 and mingles with the cleaning solution sprayed by each nozzle, atomizing the cleaning solution to produce very fine liquid droplets. Air flowing through chamber 53 further tends to maintain the droplets within the respective spray patterns.

Figure 5:
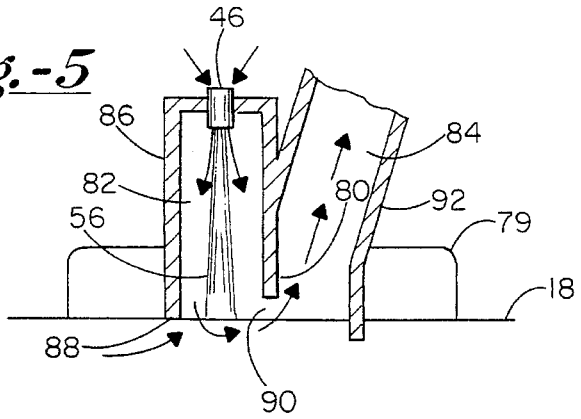
FIG. 5 is a sectional view taken along the line 5—5 in FIG. 4.

As best seen in FIG. 5, a base 79 supports the cleaning tool head in the operating position. For certain applications, base 79 can incorporate rollers, pads, guide plates or other structure to properly orient the tool head. When the cleaning tool head is in the operating position, shell 32 cooperates with floor 18 whereby chamber 53 is substantially enclosed. A partition 80 divides the chamber into two compartments: an intake compartment 82 for receiving a liquid spray and air, and an evacuation compartment 84 for drawing a vacuum to evacuate cleaning solution and air from the chamber.

A forward wall 86 of the shell has a bottom edge that cooperates with respected bottom edges of end walls 72 and 74 to provide a planar lower edge portion 88 of the shell. Lower edge portion 88 remains in surface engagement with floor 18 to determine the cleaning tool head operating position. A lower edge of partition 80 is parallel to lower edge portion 88, but spaced apart by a predetermined distance to form a gap 90 between the floor and the partition. In the one preferred embodiment, gap 90 is approximately 0.030 inches wide, and the partition and shell are approximately 12 inches long.

A rear wall 92 of the shell is not coplanar with edge portion 88, but rather extends beyond the edge portion and into carpeted floor 18. The purpose for this further extension is explained below.

Figure 6:
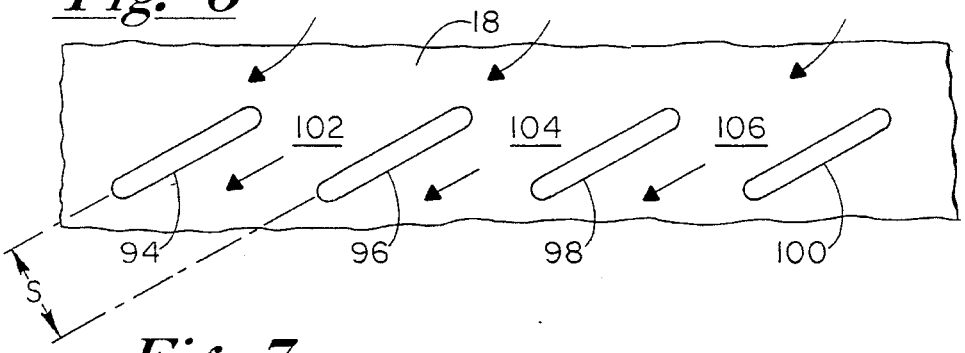
FIG. 6 illustrates a pattern formed by several sprays of cleaning solution impinging upon a surface being cleaned.

The manner in which the spray patterns cooperate to cover floor 18 across the shell length is seen from FIG. 6, which shows the portion of floor 18 beneath the cleaning tool head. Four elongate impingement areas are shown at 94, 96, 98, and 100. Each impingement area represents the portion of the floor subject to direct spray from its associated nozzle. The shape of the impingement areas reflects the thin, sheet-like volumes of their spray patterns. The impingement area locations reflect the fact that the spray patterns are preferably aimed to reach the floor near gap 90. The angular offset of the impingement areas tracks the above-discussed angular offset of nozzles 44–50. Because of the angular offset, adjacent spray patterns are separated from one another, despite regions 62–66 of longitudinal overlap. The separation between adjacent spray patterns, designated s in the figure, is essentially transverse because of the slight offset angle. Due to the extended length of the impingement areas (or the spray patterns near floor 18), the slight angular offset is sufficient to yield the required separation s, about 0.2 inches (0.51 cm). The separation can vary, depending on the width and type of the spray patterns.

One benefit of isolating spray patterns in this manner is the elimination of interference between neighboring patterns throughout the region of longitudinal overlap. Cleaning solution droplets are prevented from colliding with the counterpart droplets in adjacent spray patterns. As a result, all droplets are kept moving, under control of the vacuum pull and air entering the chamber through slots 78 and between the floor and shell. In the absence of collisions, there is virtually no tendency for the droplets to lose velocity or collect to form larger droplets or pools on floor 18.

Another benefit of the angular offset is the provision of clear air passageways 102, 104 and 106 between adjacent spray patterns. Arrows illustrate the manner in which air flow is facilitated, regardless of whether it enters chamber 53 through slots 78, or along and near lower edge portion 88. In either event, the clear air flow passageways substantially improve the efficiency of the vacuum source in controlling movement of the cleaning solution. This improves retrieval of the solution and foreign material from the surface being cleaned.

Figure 7:
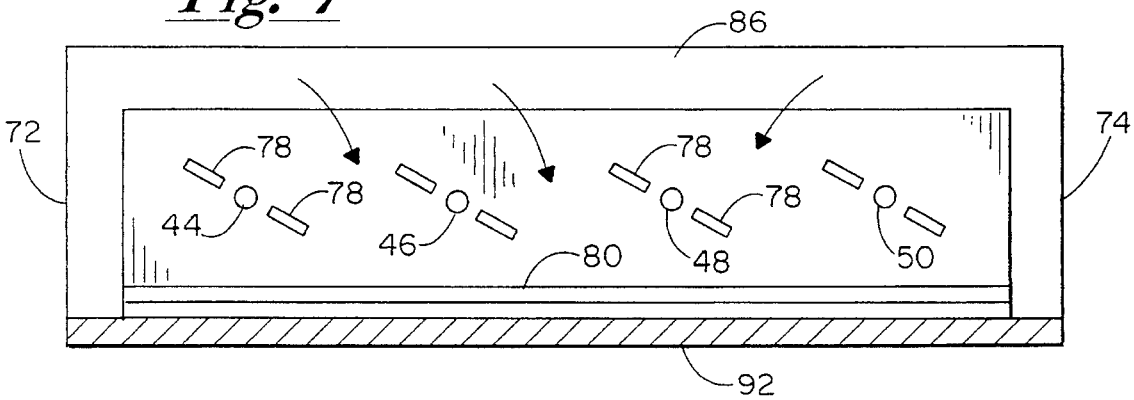
FIG. 7 is a bottom view of a cleaning tool head of the device.

The bottom of shell 32 is shown in FIG. 7, illustrating how the bottom edges of forward wall 86 and end walls 72 and 74 cooperate to provide lower edge portion 88. Rear wall 92 appears in section, due to its extension downwardly into the carpet floor when the shell is in the operating position. Because of the porosity of the carpeting, the vacuum in chamber 53 draws air through the carpeting and into the chamber. As indicated by the arrows, air enters principally along lower edge portion 88 and thus principally enters intake compartment 82. The extension of rear wall 92 tends to prevent passage of air, not only due to the added length but also because it tends to compress the nap of the carpet. Consequently, nearly all air drawn into the chamber enters the intake compartment rather than the evacuation compartment. The air mingles with the droplets of cleaning solution proximate and upstream of gap 90, where it combines with air introduced through slots 78 to carry the droplets and extracted material, through the gap and into the evacuation compartment. Because of the porosity of the carpeting, air and liquid droplets penetrate the carpeting beneath the gap to extract foreign matter from beneath surface 18. Also because of the carpeting porosity walls 72, 74, 86 and 92 can be substantially rigid, e.g. constructed of plastic or metal.

Accordingly, a nozzle orientation that prevents spray pattern interference, in combination with a unique wall construction near the bottom of the shell, increases cleaning efficiency by minimizing droplet collisions and providing a controlling air flow that maintains droplet velocities for improved recovery of the cleaning liquid. To varying degrees, these advantages are realized by several alternative nozzle arrangements.

Figure 8:
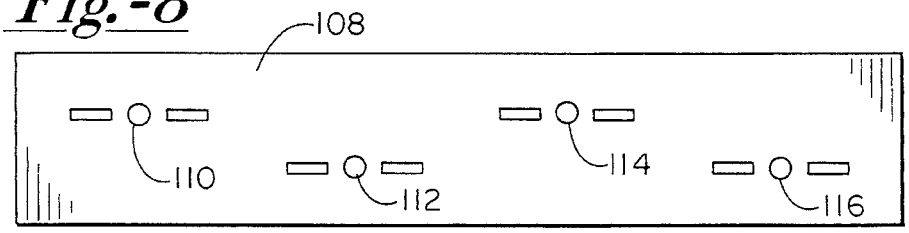
FIG. 8 illustrates a fluid spray nozzle arrangement of an alternative embodiment cleaning device.

For example, FIG. 8 illustrates a shell top wall of an alternative embodiment cleaning tool head 108. Four nozzles are mounted in the top wall, as indicated at 110–116. A manifold (not shown) supplies the cleaning solution to the nozzles and is curved or otherwise shaped to coincide with the staggered arrangement of nozzles. Each of the nozzles is longitudinally oriented, so that the major dimension of its spray pattern runs parallel to the length of the shell.

Figure 9:
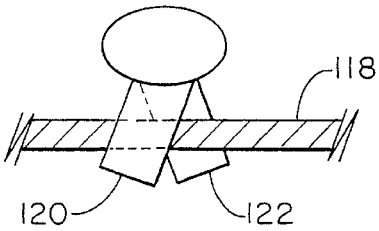
FIG. 9 is an end view of another nozzle arrangement of a further alternative embodiment cleaning device.

FIG. 9 depicts another alternative nozzle arrangement, in which several nozzles are mounted in a shell 118 in angularly staggered fashion. While only two nozzles 120 and 122 are visible in this end view, it can be appreciated that the angular staggering can correspond to the linear or transverse staggering shown in FIG. 8.

Figure 10:
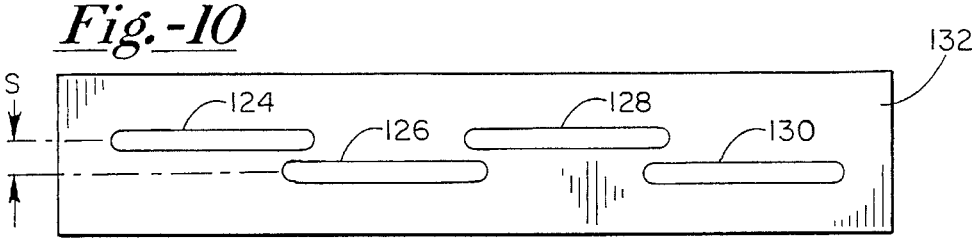
FIG. 10 illustrates an impingement pattern formed by either of the embodiments of FIGS. 8 and 9.

FIG. 10 illustrates a staggered pattern of impingement areas 124–130. The impingement areas are longitudinally aligned along a surface 132, and adjacent impingement areas longitudinally overlap one another. Interference and droplet collisions are avoided because of a transverse spacing s separating the adjacent spray patterns at the surface.

The impingement areas in FIG. 10 are formed using either of the arrangements illustrated in FIGS. 8 and 9. In both cases, the nozzles produce thin, fan-shaped spray patterns. One difference is that the arrangement in FIG. 8 produces vertical or nearly vertical spray patterns that are parallel to one another, so that the separation s remains constant. By contrast, in the arrangement of FIG. 9 the separation between adjacent flow patterns increases in the direction away from nozzles 120 and 122.

Figure 11:
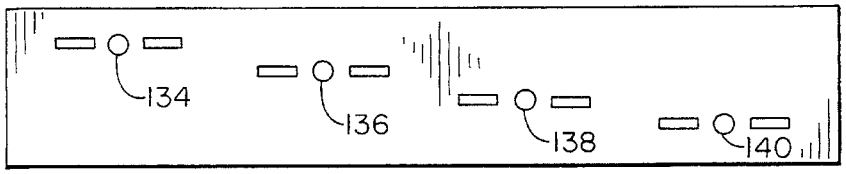
FIG. 11 illustrates a nozzle arrangement according to another embodiment of the cleaning device.
Figure 12:
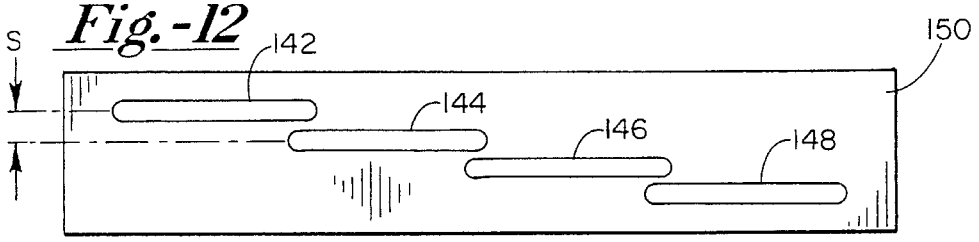
FIG. 12 shows an impingement pattern corresponding to the embodiment of FIG. 11.

FIG. 11 illustrates a further alternative arrangement of four nozzles 134–140 mounted in the top wall of a shell 142, in a row that defines a straight line angularly offset from the shell length direction. Individual nozzles are aligned in the length direction. Thus the manifold (not shown) can be linear, although not parallel with the shell. FIG. 12 shows the resulting pattern of impingement areas 142–148 on a surface 150.

As perhaps best seen from FIGS. 10 and 12, the alternative arrangements of FIGS. 8, 9 and 11 provide spray patterns that retain the longitudinal orientation, while also longitudinally overlapping one another without interference.. A disadvantage of these arrangements is that they do not provide clear air passageways to the extent provided by the first embodiment.

Figure 13:
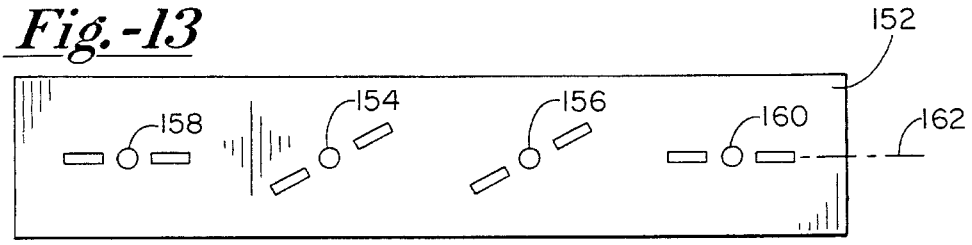
FIG. 13 shows a nozzle arrangement of yet another embodiment of the cleaning device.

A further alternative arrangement is shown in FIG. 13, where a row of nozzles mounted to a tool cleaning head shell 152 includes two interior nozzles 154 and 156, and two end nozzles 158 and 160. The interior nozzles are angularly offset from a longitudinal axis 162, in a manner similar to first embodiment nozzles 44–50. The end nozzles, however, are longitudinally aligned.

Figure 14:
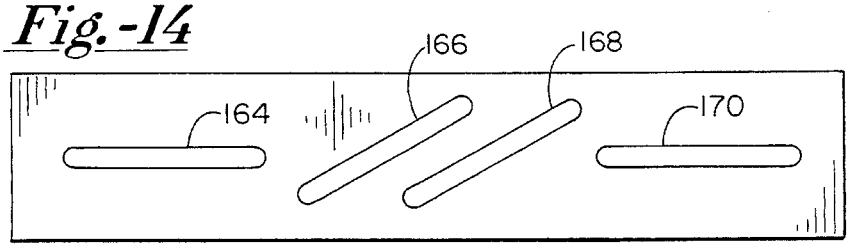
FIG. 14 illustrates an impingement pattern corresponding to the embodiment of FIG. 13.

FIG. 14 illustrates the resulting pattern of impingement areas 164–170. This arrangement allows a longitudinal alignment of the exterior or end spray patterns, while retaining the advantages of longitudinal overlap without interference and clear air passageways between adjacent spray patterns. However, the separation s between each of impingement areas 164 and 170 and its adjacent impingement area is reduced, or alternatively is of comparable size only if the angular offset of the interior nozzles is increased.

FIGS. 15 and 16 illustrate, in side sectional view and bottom view respectively, an alternative shell 172 adapted for use on rigid surfaces, e.g. ceramic tile, concrete and linoleum. A cleaning tool head 174 includes an arrangement of nozzles 176 for spraying a liquid Cleaning solution into an intake compartment 178 of a chamber 180. An evacuation chamber of the sector is coupled to a vacuum source to draw the liquid droplets and air through a gap between a partition 182 and surface 184 as before. A lower portion 186 of a forward wall 188 of the shell is formed of a porous material, e.g. a carpet pad. Opposite end walls of the shell likewise have respective porous lower portions 190 and 192. If desired, lower portions 186, 190, and 192 can be provided as a removable attachment to a rigid shell structure. By contrast, a rear wall 194 of the shell is non-porous. If desired, a lower portion 196 of the rear wall can be formed of a flexible material, to create a wiping action against surface 184 as the cleaning tool head is moved across the surface. Because surface 184 is relatively unyielding, a bottom edge of the rear wall is substantially coplanar with the bottom edges of the forward wall and end walls, which together provide a lower edge portion 186 for positioning the shell with respect to the floor.

The porous material along the edge portion 186 facilitates passage of air into the chamber. Meanwhile, non-porous rear wall 198 substantially prevents such passage of air. Accordingly, once again virtually all air entering chamber 180 enters the intake compartment and thus contributes to the recovery of cleaning solution and the extraction of foreign matter from surface 184.

With nozzles 176 angled as shown, the above-discussed improved air flow and drying .action often eliminate the need for wiping action, so that the entire shell parameter, including rear wall 198 can be porous.

Thus in accordance with the present invention, fluid spray nozzles within a cleaning tool head are oriented to provide longitudinal overlap of adjacent flow patterns, while avoiding droplet collisions or other interference along the regions of longitudinal overlap. Angularly offset and parallel spray patterns afford the further advantage of defining clear air passageways between adjacent flow patterns, for enhanced control and movement of the liquid solution droplets. To further enhance efficiency, the shell of the cleaning tool head can be constructed to promote air flow into the shell only along a selected section of the shell perimeter, e.g. along the forward and opposed end walls, while at the same time restricting passage of air along the rear wall. This insures that most air enters the chamber upstream of an air gap within the chamber, so that the air carries liquid droplets and other matter through the gap to enhance extraction and recovery.

What is claimed is:

1. A surface cleaning device, including:

a cleaning tool head including a shell having a longitudinal axis extended in a longitudinal direction, and a plurality of fluid spray means mounted to the shell in a row that extends across the shell along said longitudinal axis;

wherein the shell has a substantially planar edge portion adapted for engaging a surface to be cleaned; said edge portion, when contiguous with the surface, orienting the shell and the cleaning tool head in an operating position in which the shell and the surface cooperate to define an enclosed chamber;

wherein each of the fluid spray means sprays fluid in a generally planar and sheet-like spray pattern, and the fluid spray means are angularly offset from the longitudinal axis by a predetermined offset angle of 1–15 degrees, whereby the spray patterns of the fluid spray means are parallel to one another and define, on said surface, respective elongate spaced apart fluid impingement areas angularly offset from the longitudinal direction by said predetermined offset angle; and wherein adjacent ones of said fluid impingement areas extend beyond one another to provide regions of overlap, and along said regions of overlap are spaced apart from one another by a distance of at least 0.2 inches (0.5 cm).

2. The cleaning device of claim 1 wherein:

each of the spray patterns is fan-shaped, diverging in the direction from its associated fluid spray means toward the surface.

3. The cleaning device of claim 1 further including:

a fluid source outside of the chamber and in fluid communication with the fluid spray means, for providing a fluid under pressure to the fluid spray means.

4. The cleaning device of claim 1 further including:

an inlet passage means, proximate each of the fluid spray means, for allowing air to enter the chamber.

5. The cleaning device of claim 4 wherein:

each of said fluid spray means is a fluid spray nozzle mounted to the shell, and wherein the air inlet means comprises two elongate slots in the shell on opposite sides of each said fluid spray nozzle.

6. The cleaning device of claim 5 further including:

a fluid source and a manifold in fluid communication with the fluid spray nozzles, for supplying a fluid under pressure to the nozzles.

7. The cleaning device of claim 4 further including:

a vacuum source in fluid communication with the chamber, for drawing fluids from the chamber.

8. The cleaning device of claim 7 further including:

a partition within the chamber for dividing the chamber into an intake compartment and an evacuation compartment, said partition having a partition edge positioned near said surface when the cleaning tool head is in the operating position, thereby to determine a narrow passageway extending across the chamber; and wherein the fluid spray means are open to the intake compartment and spray fluid toward the surface near said passageway, and the vacuum source is in fluid communication with said evacuation compartment.

9. The cleaning device of claim 8 wherein:

said predetermined offset angle is about 3 degrees.

10. The cleaning device of claim 8 wherein:

said shell includes a first wall portion along said intake compartment and a second wall portion along the evacuation compartment, and said edge portion comprises a lower edge of said first wall portion; and wherein the second wall portion extends downwardly beyond the edge portion and into material defining said surface.

11. The cleaning device of claim 8 wherein:

said shell includes a porous first wall portion along the intake compartment, and a non-porous second wall portion along the evacuation compartment; and wherein said edge portion comprises a lower edge of said first wall portion.

12. The cleaning device of claim 11 wherein:

said second wall portion is flexible.

13. A vacuum cleaning apparatus, including:

a cleaning tool head including an elongate shell and a fluid spray means mounted to the shell;

wherein said shell has a substantially planar edge portion adapted for engaging a surface to be cleaned; said edge portion, when contiguous with the surface, orienting the shell and the cleaning tool head in an operating position in which the shell and the surface cooperate to define a substantially enclosed chamber;

a partition inside the chamber and extending across the chamber, for dividing the chamber into an intake compartment for receiving fluids and an evacuation compartment for evacuation of fluids, said partition having a linear edge disposed near said surface when the cleaning tool head is in the operating position, to define a narrow gap extending across the chamber between the partition and said surface;

wherein the fluid spray means is open to the intake compartment and sprays fluid toward the surface proximate said gap;

a vacuum source in fluid communication with the evacuation compartment, for drawing a vacuum to thereby draw fluids from the intake compartment across the gap and into the evacuation compartment; and wherein said shell includes a first wall portion along said intake compartment and a second wall portion along the evacuation compartment, said first wall portion including said edge portion and being formed of a porous material to to permit the passage of air from outside of the chamber into the intake compartment, and said second wall portion being substantially non-porous to interfere with the passage of air into the evacuation compartment.

14. The vacuum cleaning apparatus of claim 13 wherein:

said second wall portion is flexible.

15. The vacuum cleaning apparatus of claim 13 wherein:

said first wall portion comprises a forward wall and two opposite side walls of the shell, and said second wall portion comprises a rearward wall of the shell.

16. The vacuum cleaning apparatus of claim 13 wherein:

said fluid spray means comprises a plurality of fluid spray nozzles mounted to the shell.

17. The vacuum cleaning apparatus of claim 16 further including:

a plurality of elongate slots in the shell, a pair of said slots formed on opposite sides of each of said fluid spray nozzles.

18. A cleaning tool head for a surface cleaning device, including:

a shell having a substantially planar edge adapted for engaging a surface to be cleaned; said planar edge, when contiguous with the surface, orienting the shell in an operating position in which the shell and the surface cooperate to define a substantially enclosed chamber;

a plurality of fluid spray means mounted to the shell in a row that extends across the shell in a longitudinal direction, each of said fluid spray means adapted for spraying a liquid in a generally planar and sheet-like spray pattern;

wherein the fluid spray means are angularly offset from said longitudinal direction by a predetermined offset angle of 1–15 degrees, whereby their corresponding spray patterns are parallel to one another and define, on said surface, respective elongate spaced apart fluid impingement areas substantially parallel to one another and angularly offset from said longitudinal direction by said predetermined offset angle; and wherein adjacent ones of the spray patterns extend beyond one another to define areas of overlap between each pair of adjacent fluid spray means, and the adjacent fluid spray means along the areas of overlap are separated from one another by at least 0.2 inches (0.51 cm).

19. The cleaning tool head of claim 18 wherein:

each of the spray patterns is fan-shaped, diverging in the direction from its associated fluid spray means toward the surface.

20. The cleaning tool head of claim 18 further including:

an inlet passage means, proximate each of the fluid spray means, for allowing air to enter the chamber.

21. The cleaning tool head of claim 18 wherein:

said offset angle is approximately 3 degrees.

22. The cleaning tool head of claim 18 further including:

a partition inside the chamber and extending across the chamber, for dividing the chamber into an intake compartment for receiving fluids and an evacuation compartment for evacuation of fluids, said partition having a linear edge disposed near said surface when the cleaning tool head is in the operating position, to define a narrow gap extending across the chamber between the partition and said surface;

wherein the fluid spray means are open to the intake compartment and sprays fluid toward the surface proximate said gap;

a vacuum source in fluid communication with the evacuation compartment, for drawing a vacuum to thereby draw fluids from the intake compartment across the gap and into the evacuation compartment; and wherein said shell includes a first wall portion along said intake compartment and a second wall portion along the evacuation compartment, said first wall portion including said edge portion and being adapted to permit the passage of air from outside the chamber into the intake compartment, and said second wall portion being adapted to interfere with the passage of air from outside the chamber into the evacuation compartment.

23. The cleaning tool head of claim 22 wherein:

said first wall portion is substantially non-porous, said planar edge comprises a lower edge of the first wall portion, and the second wall portion extends downwardly beyond the lower edge and into material defining the surface.

24. The cleaning tool head of claim 23 wherein:

said first wall portion is substantially rigid.

* * * * *